US007478596B2

(12) United States Patent
Theurer

(10) Patent No.: US 7,478,596 B2
(45) Date of Patent: Jan. 20, 2009

(54) METHOD AND MACHINE FOR REPLACING DAMAGED RAIL SECTIONS OF A TRACK

(75) Inventor: Josef Theurer, Vienna (AT)

(73) Assignee: Franz Plasser Bahnbaumaschinen - Industriegesellschaft GmbH, Vienna (AT)

( * ) Notice: Subject to any disclaimer, the term of this patent is extended or adjusted under 35 U.S.C. 154(b) by 290 days.

(21) Appl. No.: 11/393,959

(22) Filed: Mar. 30, 2006

(65) Prior Publication Data

US 2006/0219123 A1 Oct. 5, 2006

Related U.S. Application Data

(60) Provisional application No. 60/671,014, filed on Apr. 13, 2005.

(30) Foreign Application Priority Data

Mar. 30, 2005 (AT) ..... A 533/2005

(51) Int. Cl.
*E01B 29/05* (2006.01)
*E01B 29/00* (2006.01)
*E01B 11/44* (2006.01)

(52) U.S. Cl. ..... 104/2; 104/5; 104/15

(58) Field of Classification Search ..... 104/2, 104/3, 4, 5, 6, 9, 15, 20; 219/53; 701/1, 701/7, 8, 9, 19, 20, 24, 25, 26, 35, 300
See application file for complete search history.

(56) References Cited

U.S. PATENT DOCUMENTS 3,254,455 A * 6/1966 Hensley ..... 451/347
3,807,310 A * 4/1974 Erna et al. ..... 104/2
4,040,292 A * 8/1977 Theurer et al. ..... 73/84
4,046,077 A * 9/1977 Theurer et al. ..... 104/2
4,207,820 A * 6/1980 Cicin-Sain ..... 104/2
4,274,334 A * 6/1981 Lund ..... 104/2
4,784,063 A * 11/1988 Theurer et al. ..... 104/3
4,929,816 A * 5/1990 Theurer et al. ..... 219/53
4,983,801 A * 1/1991 Theurer et al. ..... 219/54
5,074,219 A * 12/1991 Theurer et al. ..... 104/17.2
5,181,472 A * 1/1993 Scheuchzer ..... 104/2
5,222,435 A * 6/1993 Theurer et al. ..... 104/2
5,243,918 A * 9/1993 Bounds ..... 104/2
5,467,717 A * 11/1995 Theurer et al. ..... 104/6
5,469,791 A * 11/1995 Theurer et al. ..... 104/5

(Continued)

FOREIGN PATENT DOCUMENTS

EP 0 326 794 A1 8/1989

*Primary Examiner*—Mark T Le
*Assistant Examiner*—Jason C Smith
(74) *Attorney, Agent, or Firm*—Laurence A. Greenberg LLP; Werner H. Stemer; Ralph E. Locher

(57) ABSTRACT

In a method for efficiently removing a great number of damaged rail sections, after a first separating cut, the severed free rail ends are gripped by a rail pulling device connecting the rail ends to one another, and are pulled towards one another. The pulling force required for the pulling-together as well a current rail temperature are registered for calculation of that length of a replacement rail which is required for producing a desired rail tension. A second separating cut is carried out—with corresponding path measurement—spaced at a distance from the first separating cut as calculated on the basis of the selected length of the replacement rail.

8 Claims, 2 Drawing Sheets

U.S. PATENT DOCUMENTS 5,493,499 A * 2/1996 Theurer et al. ..... 701/207
6,415,720 B2 * 7/2002 Theurer et al. ..... 104/7.3
6,422,150 B2 * 7/2002 Theurer et al. ..... 104/2
6,474,241 B2 * 11/2002 Theurer et al. ..... 104/9
6,515,249 B1 * 2/2003 Valley et al. ..... 219/55
6,591,755 B2 * 7/2003 Theurer et al. ..... 104/2
6,655,296 B2 * 12/2003 Theurer ..... 104/2
6,698,358 B2 * 3/2004 Theurer et al. ..... 104/2
6,782,955 B2 * 8/2004 Theurer et al. ..... 171/16
6,792,870 B2 * 9/2004 Theurer et al. ..... 104/9
6,925,366 B2 * 8/2005 Theurer et al. ..... 701/19
7,253,380 B2 * 8/2007 Miller ..... 219/617
2001/0050023 A1 * 12/2001 Theurer et al. ..... 104/2
2001/0050024 A1 * 12/2001 Theurer et al. ..... 104/7.3
2002/0148378 A1 * 10/2002 Theurer ..... 104/2
2003/0097235 A1 * 5/2003 Theurer et al. ..... 702/150
2006/0219123 A1 * 10/2006 Theurer ..... 104/2
2006/0261044 A1 * 11/2006 Theurer et al. ..... 219/53

* cited by examiner 44
43
42
1
2
4
5
7
29
25
20
12
14
27
24

METHOD AND MACHINE FOR REPLACING DAMAGED RAIL SECTIONS OF A TRACK

CROSS-REFERENCE TO RELATED APPLICATION

This application claims the priority, under 35 U.S.C. § 119, of Austrian patent application A 533/2005, filed Mar. 30, 2005; the application further claims the benefit, under 35 U.S.C. § 119(e), of provisional patent application No. 60/671,014, filed Apr. 13, 2005; the prior applications are herewith incorporated by reference in their entirety.

BACKGROUND OF THE INVENTION

1. Field of the Invention

The invention relates to a method of removing damaged rail sections from welded rails of a track having an actual rail tension and an actual rail temperature. Following two separating cuts—wherein a rail gap and two rail ends are formed—a replacement rail is welded to the two rail ends. The invention further pertains to a machine for producing a rail weld.

2. Description of the Related Art

Numerous methods or devices for welding rail ends to one another have become known in the art. By way of example, reference is had to U.S. Pat. No. 4,929,816, to European patent specification EP 0 326 794, and to U.S. Pat. Nos. 4,983,801 and 6,515,249.

U.S. Pat. No. 5,469,791 describes a process in which rails are transported to the installation site by way of a special machine. A rail pulling device and a welding unit are furnished by a second and a third machine.

The prior art methods and devices are subject to shortcomings and efficiency drawbacks.

SUMMARY OF THE INVENTION

It is accordingly an object of the invention to provide a method and an apparatus for replacing damaged rail segments of a track which overcome the above-mentioned disadvantages of the heretofore-known devices and methods of this general type and which render it possible to execute in an efficient manner a great number of welds and to achieve a desired rail tension.

With the foregoing and other objects in view there is provided, in accordance with the invention, a method of replacing a damaged rail section of a welded rail of a track, the method which comprises:

cutting through a rail to form a first separating cut and two rail ends spaced by a rail gap, gripping the two rail ends with a rail pulling device, and pulling the rail ends towards one another with a pulling force f for closing the rail gap;

measuring the pulling force f required for pulling the rail ends together and measuring a current rail temperature, and calculating therefrom a length of a replacement rail required for producing a desired rail tension after welding the replacement rail into the track;

cutting through the rail to form a second separating cut at a measured distance from the first separating cut derived in the calculating step on the basis of the selected length of the replacement rail and welding the replacement rail into the track at the locations of the first and second separating cuts.

In accordance with an added feature of the invention, the rail gap formed by a distance between the two severed rail ends is measured following the first separating cut.

In accordance with an additional feature of the invention, replacement rails of various lengths are kept on hand and the replacement rails are stored with reference to respective lengths thereof in a storage medium of a control- and computing unit.

In accordance with a further feature of the invention, the following additional method step is advantageously implemented: automatically adapting the calculation of the required length of the replacement rail with the control- and computing unit to fit one of the stored replacement rails, to enable the respective replacement rail to be welded with an unchanged length to both rail ends, thus achieving the desired rail tension.

With these features of the method, it is possible to determine a difference between an actual rail tension and a desired rail tension in connection with a removal of a damaged rail section. Taking into account the found difference, it is possible to accurately establish the required length of the rail section to be removed in accordance with the length of the replacement section. The prepared replacement rail of accurate length enables a quick execution of the two required welding operations, achieving a desired rail tension. In an advantageous manner, both the removal of the damaged rail sections and the providing of replacement rails of accurately defined length can take place entirely independent of the welding process. With this, it is possible to carry out with optimal efficiency both the welding preparation and the welding itself.

A further object of the present invention lies also in creating a machine for preparation of a rail weld, with which, while achieving a particularly high working performance, an optimal preparation for producing a high-grade weld with a desired rail tension is possible.

With the above and other objects in view there is also provided, in accordance with the invention, a machine for preparation of a rail weld, comprising:

a machine frame and on-track undercarriages supporting the machine frame on a track;

a rail storage facility for storing a plurality of replacement rails;

a crane jib assembly with drives for vertically and rotatably adjusting a crane jib for gripping and unloading a replacement rail;

a vertically adjustable rail cutting saw adjustably mounted on a saw guide extending in a longitudinal direction of the machine frame;

a rail pulling device mounted on the machine frame and having two mutually spaced-apart pairs of rail clamps configured for gripping and pulling together two rail ends; and a pair of lifting rams mounted to the machine frame in immediate proximity to a respective on-track undercarriage, the lifting rams being configured to be lowered for placement upon a track, and for lifting the proximate the on-track undercarriage from the track.

In accordance with yet an added feature of the invention, the rail pulling device includes a force measuring device for registering a force f required for pulling two rail ends together. Advantagously, the machine includes a temperature measuring device for registering an actual rail temperature.

A control and computing unit is provided with a storage medium for storing therein various lengths of the replacement rails on hand in the rail storage facility.

In accordance with again an added feature of the invention, the rail cutting saw is coupled to an odometer for automatically detecting a displacement path along the saw guide.

In accordance with a preferred implementation, the control- and computing unit is configured for input of a value of a neutral temperature and connected, for registering respective measuring values, to an odometer measuring a displacement of the rail cutting saw along the saw guide, to the temperature measuring device, and to a force measuring device for registering a force f required for pulling the severed rail ends together.

In accordance with a further feature of the invention, a machine assembly for preparation of a rail weld includes a machine according to the above-outlined summary, and a second machine independently mobile of the first machine by means of a motive drive, the second machine having a device for detaching rail anchors.

In accordance with a concomitant feature of the invention, there is provided a third, independently mobile machine having a device for detaching rail anchors. The third machine is transportable by the second machine with a transporting device for transfer travel to a track construction site.

With the aid of the rail pulling device, it is possible to make use of the resulting rail gap for precise determination of a difference between an actual rail tension and the desired value thereof. A machine equipped with the features according to the invention thus makes it possible to provide a replacement rail of precisely established length, with which a desired rail tension can be achieved automatically by ultimately welding it to the two rail ends. In order to obtain the exact length of the damaged rail section to be removed, the rail cutting saw, mounted for displacement along a guide, is of particular advantage. This also enables the creation of cutting surfaces extending exactly parallel to one another on both rail ends, in order to finally obtain a weld of optimal quality with the welding of the replacement section.

Other features which are considered as characteristic for the invention are set forth in the appended claims.

Although the invention is illustrated and described herein as embodied in a method and a machine for removing damaged rail sections of a track, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
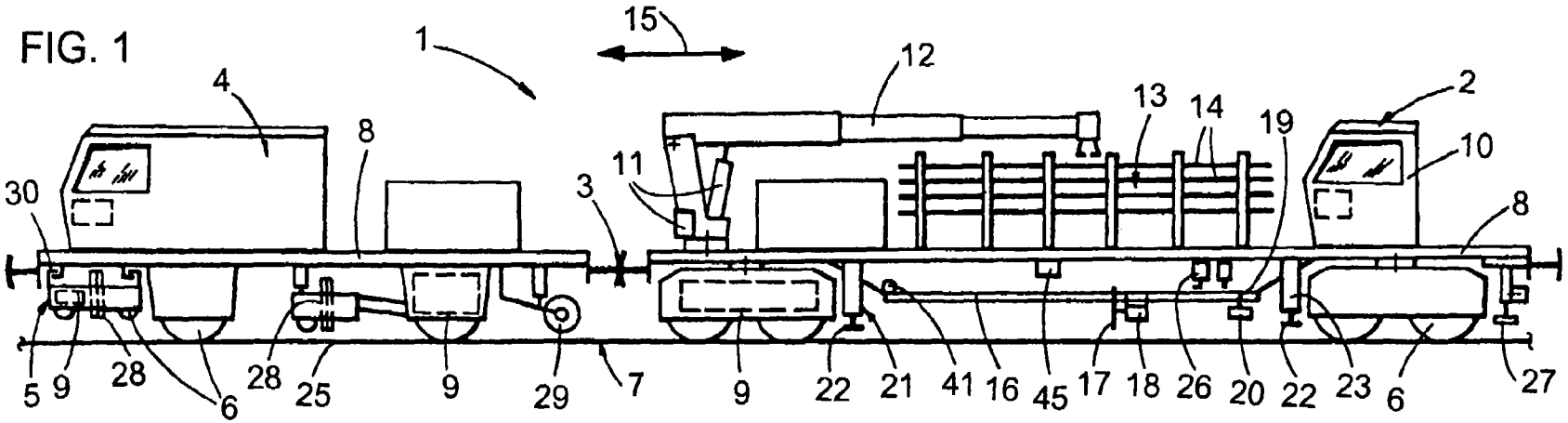
FIG. 1 is a side view of a machine assembly according to the invention for producing a rail weld.

Referring now to the figures of the drawing in detail and first, particularly, to FIG. 1 thereof, there is seen a machine assembly 1 comprising a first machine 2, a second machine 4 detachably connected to the first machine by way of a coupling 3, and a third machine 5 designed to be transported by the second machine 4 during transfer travel. Each of the machines 2, 4, 5 includes a machine frame 8 that is mobile by way of on-track undercarriages 6 that run on a track 7, and each is equipped with a motive drive 9.

The first machine 2 comprises a rail storage facility 13 located between a driver's cabin 10 and a crane jib 12, the latter being vertically adjustable and rotatable by drives 11. The rail storage facility 13 is configured for transporting and storing a number of replacement rails 14 of different lengths. Provided underneath the machine frame 8, between the two ontrack undercarriages 6 placed at the ends, is a saw guide 16 extending in a longitudinal direction 15 of the machine, on which a rail cutting saw 17 is mounted for displacement by a drive 18. A path traveled due to the displacement of the rail cutting saw 17 is registered by an odometer 41. Connected to the machine frame 8 in immediate proximity to each ontrack undercarriage 6 is a respective pair 21 of lifting rams 22 which can be lowered upon the track 7 by means of a drive 23.

Figure 2:
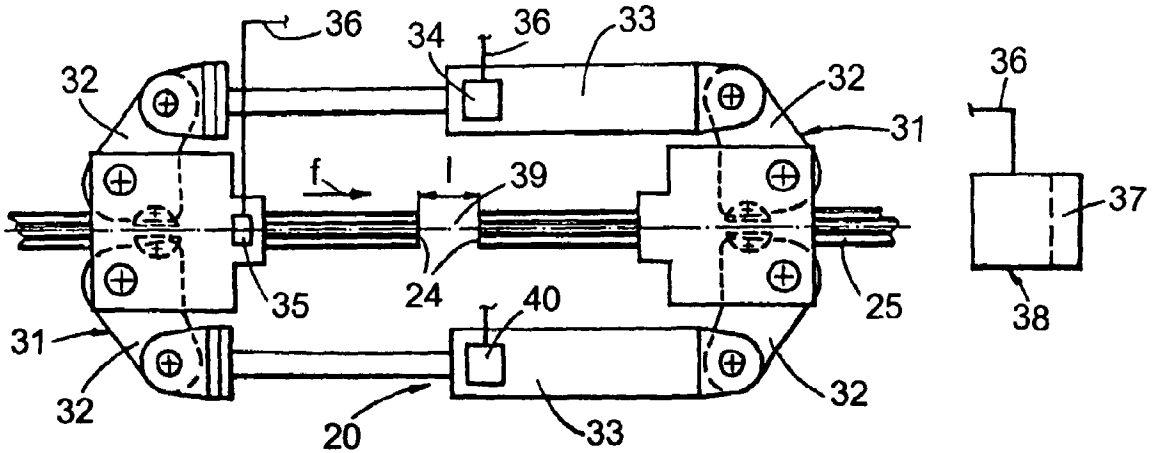
FIG. 2 is a top view of a rail pulling device for pulling two rail ends together.

A rail pulling device 20, fastened to the machine frame 8 for vertical adjustment by drives 19, is configured for gripping two rail ends 24 of a rail 25 of the track 7 (see FIG. 2). Devices 26 are provided for driving or pulling rail spikes. A vertically adjustable grinding device 27 serves for grinding rail web portions.

The second machine 4 is equipped with a vertically adjustable device 28 for detaching rail anchors, and a rotatable roller 29 for detaching base plates adhering to the rail 25. Provided in front of the front on-track undercarriage 6 is a vertically adjustable transport device 30 by which the third machine 5 can be transported on the way to the track construction site. Said third machine 5 is also equipped with a device 28 for detaching rail anchors.

The rail pulling device 20, shown in more detail in FIG. 2, comprises two pairs 31 of rail clamps 32 designed for gripping the two rail ends 24, the pairs being spaced from one another in the longitudinal direction 15 of the machine. The rail ends 24 can be pulled towards one another by actuation of two drives 33. A force f required to do so can be registered by means of a force measuring device 34. A temperature measuring device 35 is provided for detecting an actual rail temperature. Said device, as well as the force measuring device 34, is connected via lines 36 to a control and computing unit 38 having a storage medium 37. Stored in the storage medium 37 are the various lengths of the replacement rails 14, kept in stock on the rail storage facility 13, and also a respective identification feature. An odometer 40 is provided for measuring a rail gap 39 defined by the distance of the two rail ends 24 to one another.

The method of removing damaged rail sections 42 and of welding preparation will now be described in more detail in connection with the further FIGS. 3 to 15. There, a dash-dotted line 43 indicates the local installation site in the track 7, remaining unchanged in FIGS. 3 to 15 and defined by the rail section 42 to be removed.

Figures 3, 4, 5, 6, 7, 8, 9, 10, 11, 12, 13, 14, 15:
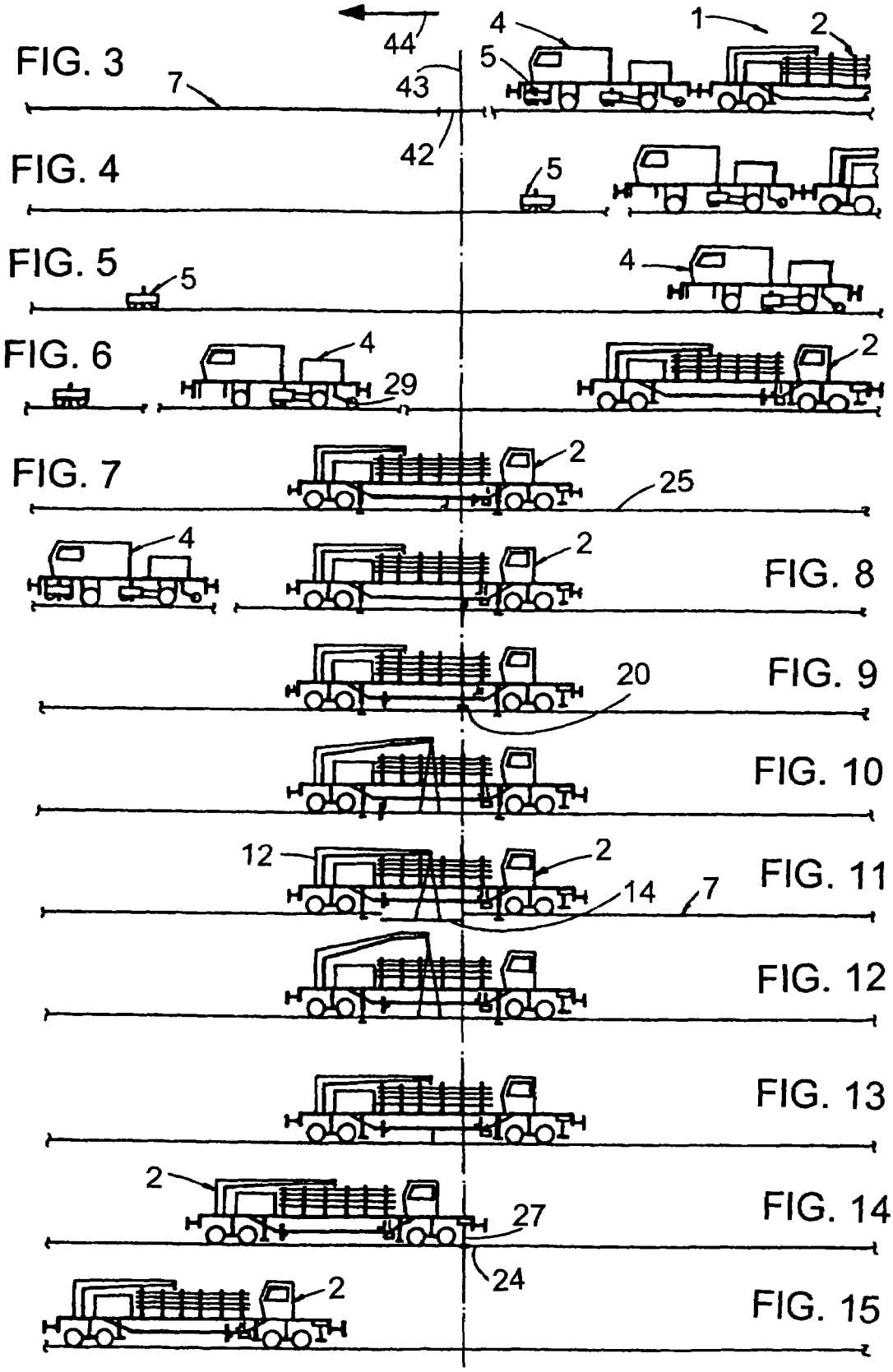
FIGS. 3-15 are respective schematic side views of the machine assembly during various stages of the method according to the invention.

The machine assembly 1 is moved in the direction represented by an arrow 44 and stopped in front of the installation site 43 (see FIG. 3). After setting the third machine 5 down upon the track 7 (FIG. 4), the sleeper anchors—lying to the left of the installation site 43 in the drawing—are detached with the aid of the device 28 until the machine 5 has reached an end position visible in FIG. 5.

Parallel to this, the second machine 4 is moved in the direction towards the installation site 43, during which the sleeper anchors—positioned to the right of the installation site 43 in the picture plane—are detached by means of the corresponding device 28 (FIG. 6). The length of those rail portions in which the rail anchors are detached is registered by an odometer wheel and transmitted by radio to the control- and computing unit 38. In the region of said rail portions, the rail spikes are also removed or loosened. With the aid of the lowered roller 29, the base plates are detached from the rail base of the rails which are lifted slightly from the sleepers.

The first machine 2 is moved to the installation site 43, and that point on the rail 25 is marked on which a first separating cut is to take place (FIG. 7).

In further sequence, as shown in FIG. 8, the rail cutting saw 17 is positioned above the marked point, and the first separating cut is carried out, resulting in the two rail ends 24 being spaced from one another, thus forming a rail gap 39 (see FIG. 2). Rotatable wire brushes 45 mounted displaceably on the machine frame 8 are pressed against a rail web of the two rail ends 24 in order to optimize the contact points intended for the welding unit. An on-track undercarriage 6 positioned at one end of the first machine 2 is raised slightly from the track 7 by lowering the associated lifting rams 22.

The rail pulling device 20 is placed upon the two rail ends 24 (FIG. 9, FIG. 2) in order to pull the same towards one another with actuation of the two drives 33 until the rail gap 39 has been eliminated. The force f necessary to do so is registered by the force measuring device 34 and recorded. In order to positively preclude an incorrect force measurement which might be caused by the rails becoming wedged, the two rail ends are pulled together repeatedly until the rail portions delimited by the removal of the rail spikes are in a tension-free state. Parallel to that, the actual rail temperature is measured with the aid of the temperature measuring device 35, and the length I of the rail gap is measured by the odometer device 40. In the meantime, the second and third machines 4,5 have been moved on to the next damaged rail section in order to detach the rail anchors over the required distance.

On the basis of the measuring values passed on to the control- and computing unit 38, and the lengths—stored in the storage medium 37—of the replacement rails 14 which are in stock and have already been prepared for optimal welding, the best-suited replacement rail 14 is calculated automatically. The rail cutting saw 17 is displaced forward on the saw guide 16 in the working direction 44, or in the longitudinal direction of the machine, with the displacement path of the saw being measured, until the length computed by the control- and computing unit 38 for the rail section 42 to be removed has been reached. Said length was calculated while taking into account the length of the selected replacement rail 14 as well as the difference between the actual rail temperature and a stored neutral temperature. Also to be taken into account with regard to the required length of the replacement rail 14 is the burning-off occurring due to the double flash-butt welding, as well as the reduction of rail length after the upset impact, in order to finally obtain a desired rail tension despite these length reductions after welding of the replacement rail 14. After a second separating cut (FIG. 10) by means of the rail cutting saw 17 and the removal of the rail spikes, the severed damaged rail section 42 is removed. It is also possible, of course, to cut off a piece of suitable length from a longer replacement rail 14, particularly if a suitable replacement rail 14 is not on hand.

With the aid of the crane jib 12, the replacement rail 14 selected by the control- and computing unit 38 is set down upon the track 7, with one end being positioned adjoining a rail end 24 (FIGS. 11, 12). The second end of the replacement rail 14 is arranged overlapping the second rail end 24, if necessary—in dependence upon the difference between the actual and neutral temperatures. To secure the position of the replacement rail 14 placed on the track 7, the corresponding rail spikes are driven into the sleepers (FIG. 13).

As can be seen in FIG. 14, the first machine 2—after lowering the raised on-track undercarriage 6—is moved forward in the working direction 44 until it is possible to work on the rail ends 24 with the rail grinding device 27. Subsequently (FIG. 15), the machine 2 moves on to the next installation site 43, where the described working steps are repeated.

The two welds for welding the replacement rail 14 are executed by means of a following welding machine, not shown, using the flash-butt welding method, wherein the relevant measuring data are passed on by radio or disc from the controlling and computing unit 38 to a control unit of the welding machine.

I claim:

1. A machine for preparation of rail weld, comprising:

a machine frame and on-track undercarriages supporting said machine frame on a track;

a rail storage facility for storing a plurality of replacement rails;

a crane jib assembly with drives for vertically and rotatably adjusting a crane jib for gripping and unloading a replacement rail;

a vertically adjustable rail cutting saw adjustably mounted on a saw guide extending in a longitudinal direction of said machine frame;

a rail pulling device mounted on said machine frame and having two mutually spaced-apart pairs of rail clamps configured for gripping and pulling together two rail ends; and a pair of lifting rams mounted to said machine frame in immediately proximity to a respective on-track undercarriage, said lifting rams being configured to be lowered for placement upon a track, and for lifting the proximate said on-track undercarriage from the track.

2. The machine according to claim 1, wherein said rail pulling device includes a force measuring device for registering a force f required for pulling two rail ends together.

3. The machine according to claim 1, which comprises a temperature measuring device for registering an actual rail temperature.

4. The machine according to claim 1, which comprises a control and computing unit having a storage medium for storing therein various lengths of the replacement rails on hand in the rail storage facility.

5. The machine according to claim 4, wherein said control- and computing unit is configured for input of a value of a neutral temperature and connected, for registering respective measuring values, to an odometer measuring a displacement of said rail cutting saw along said saw guide, to said temperature measuring device, and to a force measuring device for registering a force f required for pulling two rail ends together.

6. The machine according to claim 1, wherein said rail cutting saw is coupled to an odometer for automatically detecting a displacement path along said saw guide.

7. A machine assembly for preparation of a rail weld, comprising:

a first machine according to claim 1; and a second machine independently mobile of said first machine by means of a motive drive, said second machine having a device for detaching rail anchors.

8. The machine assembly according to claim 7, which further comprises a third, independently mobile machine having a device for detaching rail anchors, said third machine being transportable by said second machine with a transporting device for transfer travel to a track construction site.

* * * * *